United States Patent [19]

Livings et al.

[11] 4,195,415

[45] Apr. 1, 1980

[54] AIR DRIERS AND CONTROL CIRCUITS THEREFOR

[75] Inventors: Rodney Livings, Havant; Richard J. Bosiacki, Portsmouth, both of England

[73] Assignee: Thorn Domestic Applicances (Electrical) Limited, London, England

[21] Appl. No.: 888,429

[22] Filed: Mar. 20, 1978

[30] Foreign Application Priority Data

Mar. 24, 1977 [GB] United Kingdom ..... 12504/77

[51] Int. Cl.[2] ..... F26B 11/04

[52] U.S. Cl. ..... 34/48; 34/55; 219/497; 219/510

[58] Field of Search ..... 34/48, 55, 133; 219/494, 497, 501, 510

[56] References Cited

U.S. PATENT DOCUMENTS

| | | | |
|---|---|---|---|
| 3,242,585 | 3/1966 | Worst | 34/48 |
| 3,401,464 | 9/1968 | Fogt et al. | 34/48 |
| 3,526,968 | 9/1970 | Triplett | 34/48 |
| 3,553,428 | 1/1971 | McGhee | 219/492 |
| 3,975,832 | 8/1976 | Mori et al. | 34/55 |
| 4,112,589 | 9/1978 | Palfrey et al. | 34/48 |

*Primary Examiner*—Larry I. Schwartz
*Attorney, Agent, or Firm*—Fleit & Jacobson

[57] ABSTRACT

An air drier has a control circuit for controlling heating of air entering the drier to maintain the difference between the temperature of air leaving the drier and that of ambient or incoming air at a predetermined value. The control circuit is compensated for variations in ambient air temperature such that as ambient air temperature decreases the control circuit tends to maintain the temperature difference at a higher value to ensure that the drying times are not unduly lengthened. A signal for terminating operation of the drier is derived by monitoring the difference between the actual value of the temperature difference and the desired value, and the mean heater power, and for terminating the drying cycle when a signal representative of the sum of the two values passes through a predetermined value.

14 Claims, 5 Drawing Figures

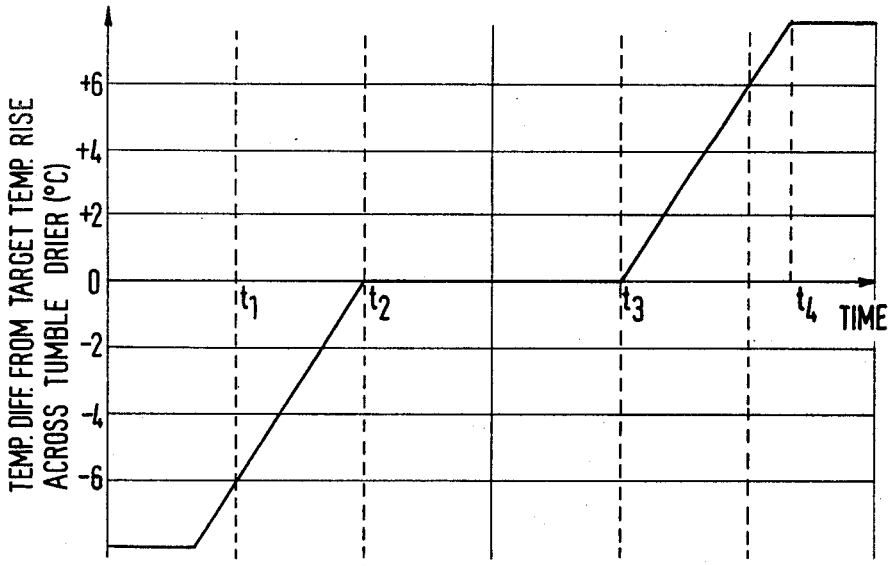
Fig. 3
Fig. 4
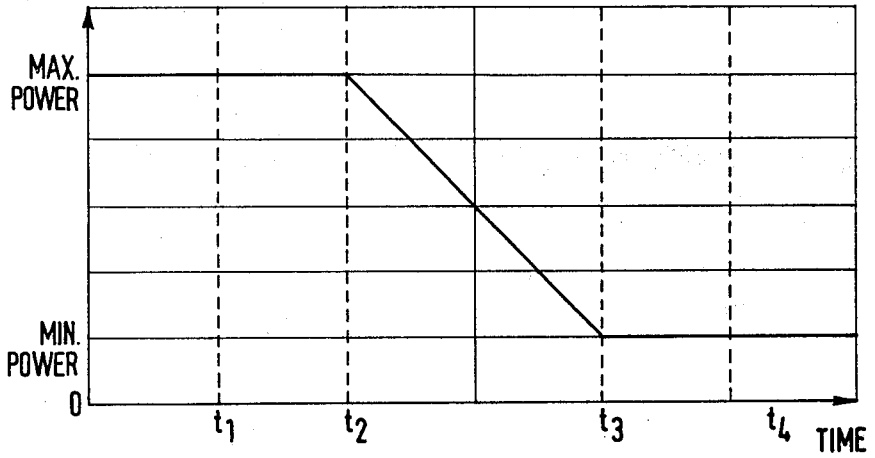

AIR DRIERS AND CONTROL CIRCUITS THEREFOR

The present invention relates to air driers and more particularly to control circuits for such driers.

The present invention relates to improvements in, or modifications of, the subject matter of our copending patent application Ser. No. 727,015; now Pat. No. 4,112,589 in which we claim an air drier comprising a chamber in which, in use, articles are placed for drying, means for causing air to pass through the chamber, means for heating the air entering the chamber, and a controller for controlling the amount of heat supplied to said air entering the chamber in dependence on the difference between the temperature of air leaving the drier and that of ambient air.

According to a first aspect of the present invention we provide an air drier comprising: a chamber in which, in use, articles are placed for drying; means for causing air to pass through the chamber; means for heating the air before it enters the chamber; and a control circuit for controlling the amount of heat supplied to the air in dependence upon the difference between the temperature of air leaving the drier and that of ambient air, the control circuit being arranged to compensate the drying characteristic of the drier automatically for variations in ambient temperature such that for decreasing values of ambient temperature, the control circuit tends to maintain said temperature difference at a higher value.

By monitoring both the temperature difference between the incoming and outgoing air and the power supplied to the heaters, it is possible to provide a signal which varies continuously throughout substantially the whole of the drying cycle so that by comparing this signal with a reference it is possible to interrupt the drying cycle reliably and consistently when this signal reaches a value corresponding to a desired dryness.

Preferably the signal which is used to represent the actual dryness of the articles is a signal representative of the sum of the mean power applied to the drier heater and the mean value of the difference between a desired value of the temperature difference between incoming and outgoing air and the actual value of the temperature difference. Such a signal is very convenient to derive and can be used to end the drying cycle by comparison thereof with a reference signal in a comparator.

According to a second aspect of the invention there is provided an air drier including means for comparing an electrical signal representative of the difference between ambient and exhaust air temperatures with a reference electrical signal to form a control signal for controlling said heating means. It has been found that it is desirable to compensate the drying characteristics in this way as if the circuit operates to control the heat supplied to the incoming air on dependence on the temperature difference between incoming and outgoing air, the effectiveness of the drier is reduced if no steps are taken to compensate the drying characteristics since the evaporation rate decreases with falling ambient temperature and thus as the ambient temperature drops so the time taken to dry articles to a required dryness is increased.

The compensating means thus acts so that for a lower ambient or incoming air temperature, the circuit acts to maintain the temperature difference between incoming and outgoing air at an appropriately higher value as compared with a temperature difference which is maintained at a higher ambient temperature.

One particularly simple way of effecting the desired compensation of the drying characteristics is to place electrically in parallel with the incoming air temperature sensing element a resistive element which, as compared with the temperature coefficient of the incoming air temperature sensing element, has a temperature coefficient which is either of the opposite sign or of the same sign and substantially less. This resistive element is preferably located on a circuit board on which the majority of the components of the control circuit are mounted, away from the air stream through the tumble drier. The air temperatures sensing elements are preferably thermistors, which have a negative temperature coefficient, and under those circumstances the compensating element should be a conventional resistor having a positive temperature coefficient. There are many other circuit arrangements which could be used to achieve the same effect, namely that for lower ambient air temperatures the control circuit operates to maintain a higher difference in temperature between incoming or ambient and outgoing air.

The invention will be further described with reference to the accompanying drawings in which:

FIGS. 3, 4 and 5 are graphs indicating how certain parameters of the tumble drier control circuit vary with time throughout a drying cycle.

Figure 1:
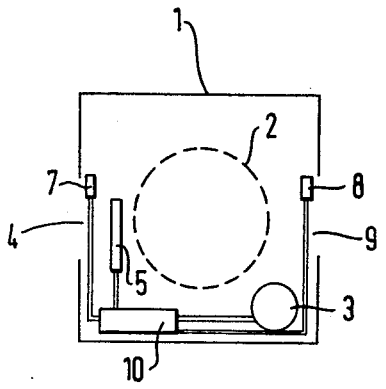
FIG. 1 shows, very schematically, a tumble drier incorporating a control circuit embodying both aspects of the present invention.

The hot air tumble drier shown in FIG. 1 comprises a casing 1 which houses a perforated rotatable chamber or drum 2 in which articles such as damp clothes are placed for drying via a hinged access door of the casing 1. In use, a motor 3 rotates the drum 2 and a fan to cause air to be drawn in through an air inlet 4 in the casing, pass through the perforated drum 2 and be exhausted by an air outlet 9. A heater 5 adjacent the inlet 4 heats the air before it enters the chamber 2. Operation of the motor 3 and heater 5 is controlled by means of a control circuit 10 which includes temperature sensing devices 7 and 8, preferably thermistors, disposed in the path of incoming and outgoing air, respectively.

Figure 2:
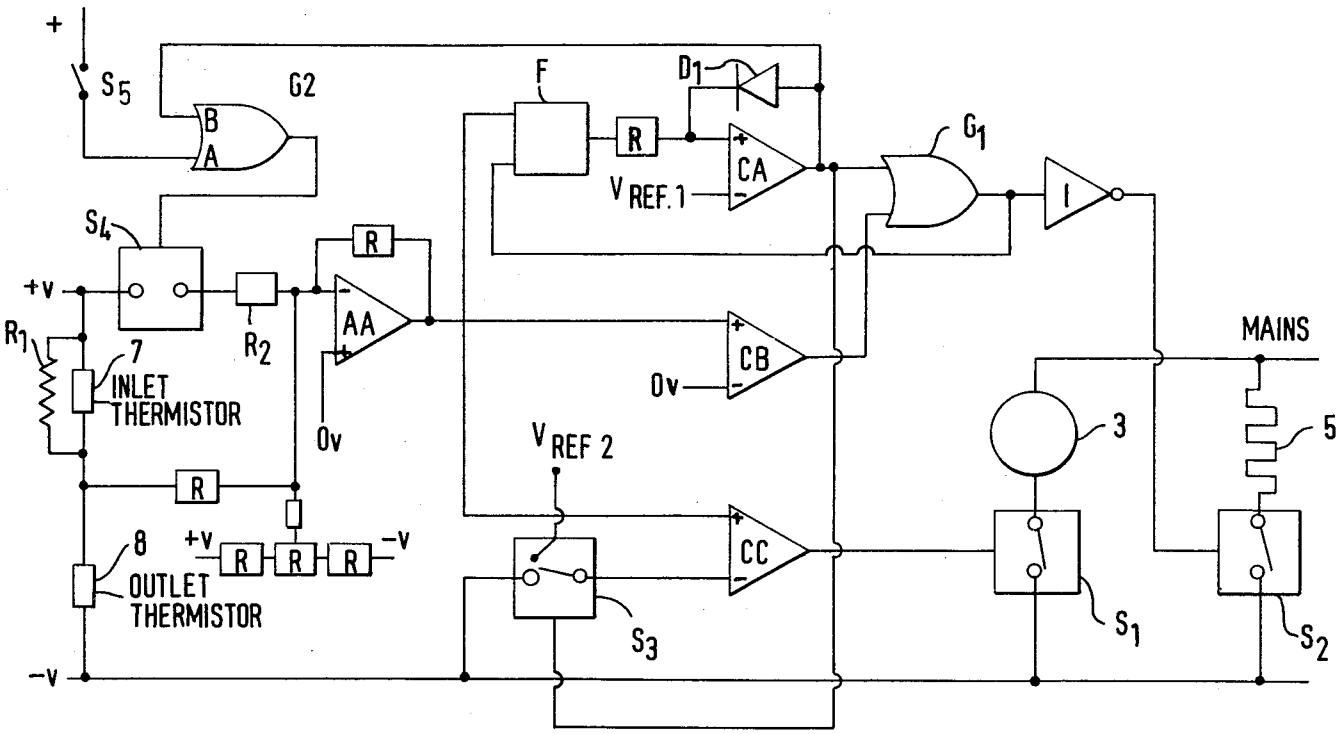
FIG. 2 is a block diagram illustrating the control circuit of FIG. 1.

The control circuit 10 is shown in block diagram form in FIG. 2. Motor 3 and heater 5 are connected in parallel with one another across an electrical mains supply and the current supplied to them is controlled by respective electronically controlled switches S1 and S2. The thermistors 7 and 8 are associated with an amplifier AA which delivers outputs to comparators CA, CB and CC which in turn control operation of the switches S1 and S2 and thus operation of the motor 3 and heater 5.

The functions of the circuit 10 are: firstly, to control the supply of power to the heater 5 so as to maintain the mean temperature difference between the incoming and outgoing air as detected by the respective thermistors 7 and 8 substantially constant at a desired value; and secondly, to end the operation of the tumble drier once predetermined conditions have been reached. The circuit 10 can selectively operate in a "boost" mode in which it maintains the mean temperature difference at a large value, for example 12° C., so that articles in the drier are dried rapidly, and in an economy mode in which it maintains a much smaller temperature differential between the incoming and outgoing air, e.g. 2° C., so that considerably less electrical power is required. Consequently, in the economy mode, the drier is cheaper to run, although the time required to dry articles to a desired dryness is prolonged as compared with operation in the boost mode.

As shown in FIG. 2, the thermistors 7 and 8 are in series across a voltage source and connected to an amplifier AA so that the output voltage of amplifier AA is representative of the difference in temperatures sensed by the thermistors 7 and 8. A resistor R1, whose function will be explained below, is in parallel with the inlet thermistor 7. During setting up of the circuit 10 the resistor R1 is unconnected and, with the electronically operated switch S4 open, the variable resistor VR1 is adjusted so that the output of amplifier AA is at 0 volts. The resistor R1 is then connected in circuit.

The function of the resistor R1 is to compensate the control characteristics of the circuit 10 for changes in ambient temperature. Thus, other conditions being equal, if the ambient temperature drops, the desired temperature difference between the inlet and outlet air must be increased for satisfactory operation and if drying times are not to be undesirably prolonged. Resistor R1, being a conventional resistor, has different temperature characteristics from the thermistors 7 and 8, and provides a bias whose effect changes with temperature so as to compensate the control characteristics of the circuit 10 in the desired fashion, i.e. as the ambient air temperature falls, so the circuit 10 tends to maintain the mean difference in ambient and outgoing air temperatures at a higher value.

For operation in the boost mode, the manually operable switch S5 is closed by the user so that a signal is applied via input A of OR gate G2 to close electronic switch S4 so that an additional positive bias is applied to the inverting input of amplifier AA via resistor R2 causing the output of amplifier A to go negative. Switch S4 (and switch S3) could be any suitable form of logic controlled switch having a signal path which is controllable by the logic state at a control input.

At this time switch S3 is in the state shown and the inverting input of comparator CC is thus connected to a negative voltage, in this case the voltage of the negative supply rail of the control circuit 10, which is more greatly negative than the output of amplifier AA. The output of comparator CC is thus at this time in the "high" state so that the switch S1 is closed and the tumble drier motor 3 operates. The switch S1 (and switch S2) suitably comprises a Triac.

As the output of amplifier AA is now negative, the output of comparator CB is low and since the output of comparator CA is also low, the output of OR gate G1 is also low. This low state is logically inverted by the invertor I so that electronic switch S2 is closed and the heater 5 energised, warming the air entering the tumble drier. The switch S2 is preferably arranged so that it only commences conduction at zero cross-overs of the electrical mains supply e.g. by including a so-called "zero voltage switch".

The temperature of the outlet air will now gradually rise so that the output of amplifier AA thus increases towards and eventually reaches zero, whereupon the output of comparator CB goes high so that the electrical supply to the heater 5 is cut off. Thermal inertia causes an overshoot of the actual temperature difference. When the temperature of the outlet air has fallen sufficiently for the output of comparator CB to go low, the heater is again operated. This process then repeats itself as the articles in the drier progressively dry. Thus during the drying period the mean temperature difference approaches the desired temperature difference. The circuit 10 thus operates to maintain the mean difference between the inlet and outlet temperatures at a substantially constant value, the value in question being relatively large, e.g. 12° C., in the boost mode to bring about rapid drying. It will be appreciated that the desired means temperature difference can be set by adjusting the amount of bias which is supplied via resistor R2 to the amplifier A when the switch S4 is closed.

Figure 5:
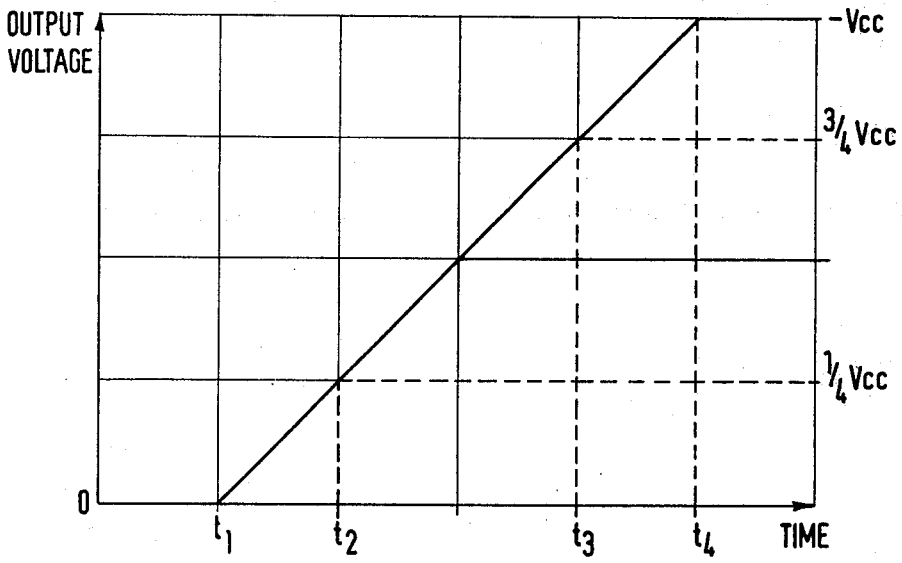

FIGS. 3, 4 and 5 which have a common time axis illustrate why it is advantageous to monitor both the mean temperature difference between the inlet and outlet air and the mean heater power. FIG. 3 shows as a function of time the mean difference between the actual difference between the inlet and outlet air temperatures and the target or desired mean temperature difference as determined by the biasing network associated with amplifier A in the circuit 10. During the time t1–t2 the tumble drier and the articles therein warm up so that the actual temperature difference approaches the desired temperature difference; during this time the heater is delivering its maximum power as shown in FIG. 4 and the articles start to dry out. After the actual mean temperature difference reaches the desired mean temperature difference at time t2, the actual temperature difference remains constant for a fairly long period as the moisture evaporates from the articles in the drier; as progressively more moisture evaporates, so less power is required to maintain the temperature differential as illustrated by the downwardly sloping portion of the power consumption curve of FIG. 4.

Eventually, at a time t3 the minimum power which can be delivered to the incoming air is reached, the minimum power being non-zero because the motor 3 becomes warm and this contributes to the heat supplied to the air through the drier. The non-zero minimum power is more noticeable when the machine is operating in the economy mode, where the maximum mean power is relatively low in any case, than in the boost mode.

Once the minimum power has been reached at time t3, as progressively more moisture is evaporated from the articles in the tumble drier, so more of the power supplied will go towards heating the outlet air so that the temperature difference curve slopes upwardly after the time t3 as indicated in FIG. 3.

At time t4 the articles are completely dry and the difference between the actual temperature difference and the desired temperature difference stabilises at a maximum value.

It will be apparent from the above, particularly when operating in the economy mode where the temperature variations and power variations are less throughout the drying cycle, that monitoring the difference between the actual temperature rise and the desired temperature rise alone or monitoring the power supplied by the heaters alone with not provide a satisfactory means of determining when a desired point in the drying cycle, corresponding to a desired dryness of the articles in the tumble drier, has been reached.

The amplifier AA has associated therewith a low pass filter F, so as to determine the end of the drying cycle. Filter F has two inputs, one receiving the output of amplifier AA and the other receiving the output of the OR gate G1 and is arranged to convert the logical output of the gate G1 to a voltage representative of the mean power supplied by the heater 5. It can do this because the state of the output of gate G1 determines whether or not the heater 5 operates. Filter F combines this analogue signal representing the mean heater power with the output of amplifier AA, which is representative of the difference between the desired temperature difference as set by the bias chain comprising resistor R2 and the actual temperature difference as measured by thermistors 7 and 8. Filter F thus applies to the non-inverting input of comparator CA a signal which is proportional to the sum of the mean output of amplifier AA and the mean heater power. The comparator A compares this input with a voltage reference $V_{REF1}$ and its output changes from the low state to the high state when the input to the comparator from the filter exceeds $V_{REF1}$.

The output voltage at the filter is thus as shown in FIG. 5 and it will be noted that this output voltage increases continuously from time t1 to and beyond time t3, eventually reaching a saturation value determined by the circuitry used. At least between the times t1 and t3 the voltage increases continuously so that comparison of this voltage with a reference voltage, i.e. $V_{REF1}$, can be used to provide a signal to end the drying cycle at almost any desired point within reason, in the drying cycle.

Thus, when the output of filter F exceeds the voltage $V_{REF1}$ the output of comparator CA goes "high" so forward biasing diode D1 to latch the comparator A in this condition and causing the logic controlled switch S3 to change from connecting the inverting input of comparator CC to the negative supply rail to connecting it to a more positive source of reference voltage $V_{REF2}$. As the output of comparator CA is latched in the high state, the switch S2 is now permanently opened so that the outlet air temperature will eventually start to fall. However, the inverting input of comparator CC is now connected to the voltage reference source $V_{REF2}$ so that as the outlet air temperature falls, the output of amplifier AA becomes progressively negative and eventually reaches $V_{REF2}$ whereupon the output of comparator CC goes low opening the switch S1, stopping the motor and thus ending the drying cycle.

The required dryness at which the drying cycle will end can be adjusted by changing the magnitude of the reference voltage $V_{REF1}$. Thus a user operable continuously variable control or a switch for selecting one of two or more desired values could be provided on the machine casing.

For operation in the economy mode, the user operable switch S5 is left open so that the bias chain comprising resistor R2 is switched out of circuit.

Initially, the output of amplifier AA is approximately zero volts and since at this time the electronic switch S3 is in the position shown in FIG. 2, the output of comparator CC is high and the motor 3 operates. The presence of damp clothes or other articles within the tumble drier drum will cause the outlet air temperature to fall and this combined with the effect of the presence of resistor R1 will cause the input to amplifier AA to move positively and thus its output to move negatively. The output of comparator CB therefore goes low and the switch S2 closes causing the heater 5 to operate. The incoming air is thus heated and the outlet air temperature gradually rises so that the output of amplifier AA increases positively towards zero. When the output reaches zero, comparator CB switches high and the electrical supply to the heater 5 is interrupted.

The output of comparator CA going high has three effects. Firstly, comparator CA is latched with its output in the high state and thus the output of OR gate G1 is high and the power to the heater 5 permanently interrupted. Secondly, the switch S3 is changed from the FIG. 2 state to the state in which it is connected to the less negative voltage reference $V_{REF2}$ and thirdly, as the output of comparator CA is delivered to the input B of OR gate G2, the switch S4 is closed, switching in the bias chain comprising resistor R2 and thus causing the output of amplifier AA to go negative.

The outlet air temperature thus falls and eventually the output of amplifier AA exceeds the voltage reference $V_{REF2}$ whereupon comparator CC switches low and the motor 3 is stopped, signifying the end of the drying cycle.

As well as the voltage reference $V_{REF1}$ being adustable by the user, it is also possible for it to be compensated according to whether the circuit is operating in the boost or economy mode so that with the user operable dryness control in the same position, articles will be dried to the same dryness irrespective of whether the boost or economy mode is used.

We claim:

1. In an air drier comprising: a chamber in which, in use, articles are placed for drying; means for causing air to pass through the chamber; and means for heating the air before it enters the chamber; the improvement comprising a control circuit for controlling the amount of heat applied to the air in dependence upon the difference between the temperature of air leaving the drier and that of ambient air, the control circuit including means for compensating the drying characteristic of the drier automatically for variations in ambient temperature such that for decreasing values of ambient temperature, the control circuit tends to maintain said temperature difference at a higher value.

2. An air drier according to claim 1 wherein the compensating means is arranged so that for progressively decreasing values of ambient temperature the control circuit tends to maintain the temperature difference at progressively higher values.

3. A control circuit according to claim 1, further comprising means for monitoring both said temperature difference and the power supplied by said heating means to derive a signal for ending a drying cycle of the drier.

4. A control circuit according to claim 1 or 3, further comprising ambient and exhaust-air temperature sensors having temperature-dependent electrical resistance characteristics.

5. A control circuit according to claim 4, wherein the ambient air sensor is disposed in the path of air entering the chamber.

6. A control circuit according to claim 4, wherein the compensating means comprises a circuit element having temperature dependent electrical characteristics different from those of the sensors.

7. An air drier according to claim 3, wherein said monitoring means comprises means for forming a signal dependent upon said temperature difference and the mean power supplied by said heating means.

8. In an air drier comprising:

a chamber in which, in use, articles are placed for drying;

means, comprising a motor, for causing air to pass through the chamber; and means for heating said air before it enters the chamber, the improvement comprising a control circuit for controlling the amount of heat supplied to the air in dependence upon the difference between the temperature of air leaving the drier and that of ambient air, the controller comprising means for monitoring both said temperature difference and the power supplied by said heating means to derive a signal for ending a drying cycle of the drier.

9. An air drier according to claim 8, wherein said monitoring means comprises means for forming a signal whose magnitude is dependent upon said temperature difference and the mean power supplied by said heating means.

10. An air drier according to claim 9, wherein said monitoring means is arranged to latch when said sum passes through a predetermined value and to inhibit operation of said heating means thereafter.

11. An air drier according to claim 10, and including means for interrupting operation of said motor after said monitoring means has latched and said temperature difference has decreased to a predetermined value.

12. An air drier according to claim 8, and including means for comparing an electrical signal representative of the difference between ambient and exhaust air temperatures with a reference signal representative of a desired value of said difference to form a control signal for controlling said heating means.

13. A drier according to claim 12 and including means for comparing said electrical signal with a further reference signal to produce a control signal for controlling said motor.

14. An air drier according to claim 13, wherein said monitoring means comprises a low pass filter having an input connected to receive said electrical signal and an input connected to receive said control signal.

* * * * *